US005941421A

United States Patent [19]

Overman et al.

[11] Patent Number: 5,941,421

[45] **Date of Patent: *Aug. 24, 1999**

[54] CONDUIT MEMBER FOR COLLAPSIBLE CONTAINER

[75] Inventors: Debra B. Overman, Oakwood, Ga.; Mladomir Tomic, Appleton, Wis.

[73] Assignee: The Coca-Cola Company, Atlanta, Ga.

[ * ] Notice: This patent is subject to a terminal disclaimer.

[21] Appl. No.: 08/991,710

[22] Filed: Dec. 17, 1997

Related U.S. Application Data

[63] Continuation of application No. 07/119,034, Nov. 10, 1987, Pat. No. 5,749,493, which is a continuation of application No. 06/542,322, Oct. 17, 1983, abandoned.

[51] Int. Cl.[6] ..... B65D 83/00

[52] U.S. Cl. ..... 222/105; 222/464.3

[58] Field of Search ..... 222/92, 95, 105, 222/107, 183, 464.1, 464.2, 464.3, 386.5; 383/33, 35, 36, 37, 46, 119, 105

[56] References Cited

U.S. PATENT DOCUMENTS

| | | | |
|---|---|---|---|
| 2,133,411 | 10/1938 | Zohe . | |
| 2,569,975 | 10/1951 | Cone . | |
| 2,804,257 | 8/1957 | Hasler et al. | 383/36 |
| 2,859,899 | 11/1958 | Kramer et al. . | |
| 2,891,700 | 6/1959 | Maynard | 222/92 |
| 2,920,798 | 1/1960 | Samuel . | |
| 3,081,911 | 3/1963 | Scholle . | |
| 3,083,875 | 4/1963 | Welty et al. . | |
| 3,090,526 | 5/1963 | Hamilton et al. | 222/105 |
| 3,171,571 | 3/1965 | Daniels . | |
| 3,197,073 | 7/1965 | Gondra et al. . | |
| 3,240,399 | 3/1966 | Frandeen . | |
| 3,257,036 | 6/1966 | Micallef . | |
| 3,260,412 | 7/1966 | Larkin . | |
| 3,342,377 | 9/1967 | Peredy . | |
| 3,361,303 | 1/1968 | Jacuzzi | 222/183 |
| 3,420,413 | 1/1969 | Corsette | 222/107 |
| 3,549,050 | 12/1970 | Bruce et al. . | |
| 3,695,314 | 10/1972 | Watts et al. . | |
| 3,718,236 | 2/1973 | Reyner et al. . | |
| 3,838,794 | 10/1974 | Cogley et al. | 222/95 |
| 3,981,415 | 9/1976 | Fowler et al. | 222/95 |
| 4,014,461 | 3/1977 | Harvill . | |
| 4,062,475 | 12/1977 | Harris et al. | 222/95 |
| 4,087,026 | 5/1978 | Petterson . | |
| 4,137,930 | 2/1979 | Scholle . | |
| 4,138,036 | 2/1979 | Bond | 222/464.3 X |
| 4,148,416 | 4/1979 | Gunn-Smith | 222/95 X |
| 4,159,790 | 7/1979 | Bailey | 222/464.2 X |
| 4,193,518 | 3/1980 | Holmes | 222/464.2 X |
| 4,257,535 | 3/1981 | Mellett . | |
| 4,265,373 | 5/1981 | Stoody . | |
| 4,266,692 | 5/1981 | Clark . | |
| 4,270,533 | 6/1981 | Andreas | 222/95 X |
| 4,284,671 | 8/1981 | Cancio et al. . | |
| 4,286,636 | 9/1981 | Credle . | |
| 4,322,020 | 3/1982 | Stone | 222/105 X |
| 4,362,255 | 12/1982 | Bond . | |
| 4,381,846 | 5/1983 | Heck | 222/105 |
| 4,445,550 | 5/1984 | Davis et al. . | |
| 4,513,884 | 4/1985 | Magid . | |
| 4,524,458 | 6/1985 | Pongrass et al. | 222/105 X |
| 4,601,410 | 7/1986 | Bond | 222/105 X |
| 4,893,731 | 1/1990 | Richter | 222/105 X |
| 5,647,511 | 7/1997 | Bond . | |

FOREIGN PATENT DOCUMENTS

| | | |
|---|---|---|
| 600684 | 10/1956 | Canada . |
| 732761 | 6/1955 | United Kingdom . |
| 756093 | 8/1956 | United Kingdom . |
| 1 473 524 | 5/1977 | United Kingdom . |
| WO 83/01605 | 5/1983 | WIPO . |

*Primary Examiner*—Kevin P. Shaver
*Attorney, Agent, or Firm*—Brinks Hofer Gilson & Lione

[57] ABSTRACT

A collapsible container comprising a flexible bag including a spout having an opening through which liquid is fed into and dispensed from the bag, and a liquid passage member inside of the bag in liquid communication with the spout opening for aiding in the dispensing of liquid from the bag. The liquid passage member is preferably integral with a wall of the bag.

26 Claims, 2 Drawing Sheets

CONDUIT MEMBER FOR COLLAPSIBLE CONTAINER

This application is a continuation of U.S. patent application Ser. No. 07/119,034 filed on Nov. 10, 1987, now issued as U.S. Pat. No. 5,749,493, which was a continuation of U.S. patent application Ser. No. 06/542,322, filed on Oct. 17, 1983 (now abandoned).

BACKGROUND OF THE INVENTION

1. Field of the Invention

The present invention relates to collapsible sealed containers to dispense liquid products, and more particularly to a flexible conduit incorporated in such a collapsible container.

2. Description of the Prior Art

Many exemplary collapsible containers are available in the prior art which permit the extraction of the product from a container. Most of the containers use conventional dip tubes including an elongated cylindrical tube which includes an upper portion connected to a valve and a lower portion positioned within the product to be extracted from the container. For example, Daniels, U.S. Pat. No. 3,171,571 discloses a conventional bag-in-box type of dispensing package including a dip tube.

Another example of a dip tube position within a flexible bag is disclosed by Kramer, et al. U.S. Pat. No. 2,859,899. The dip tube includes perforations through which the syrup or other material positioned within the flexible bag is sucked therefrom by means of a pump. U.S. Pat. No. 4,286,636 to Credle discloses a collapsible bag with an extruded dip tube including at least one channel in the peripheral surface of the dip tube and extending along substantially the entire length of the dip tube. As a vacuum or suction is applied to the dip tube by a pump, initially all of the air within the collapsible bag is extracted therefrom. Subsequently, the liquid product is dispensed out of the collapsible bag and the bag collapses around a portion of the dip tube which is no longer surrounded by the liquid product.

One of the disadvantages of the prior art collapsible containers including dip tubes is that they require the insertion of a dip tube, and thus of an additional step in the manufacture of the filled container. Additionally, because of the geometry of the dip tube and the collapsible container, the insertion of the dip tube could not be handled through automated means, but rather requires manual insertion.

SUMMARY OF THE INVENTION

Accordingly, it is a primary objective of the present invention to provide an internal flexible conduit for a collapsible container comprising a pair of rib members extending along substantially the entire length of the collapsible container.

It is another object of the present invention to provide a conduit which can be integrally formed on the interior surface of the collapsible container.

A further object of the present invention is to provide a flexible conduit for a collapsible bag which can be inserted during the formation of the bag and requires no manipulative steps after filling of the collapsible container.

The objects of the present invention are fulfilled by providing at least one pair of flexible substantially parallel rib members disposed adjacent to an interior wall of the collapsible container. The flexible rib members are positioned within a collapsible bag and substantially adjacent to an annular spout member. Initially, air within the collapsible bag will be drawn therefrom. Subsequently, the liquid product disposed within the collapsible bag will flow through a channel formed by the adjacent ribs and the collapsible bag will collapse around the rib members. Progressively, as the liquid product is removed from the collapsible bag, the bag will continue to collapse around the rib members until all of the liquid product is dispensed therefrom.

A further aspect of the present invention is that the rib members can be disposed on a web which can be disposed between two flexible sheets which comprise a collapsible bag during the manufacture of the bag. The major advantage of this development is that it avoids substantial manipulative steps both in the manufacture and assembling of the collapsible container and in the filling and use of the bag.

Further scope of applicability of the present invention will become apparent from the detailed description given hereafter. However, it should be understood that the detailed description of the invention and the specific examples, while indicating preferred embodiments of the invention are given by way of illustration only, since various changes and modifications within the spirit of the invention will become apparent to those skilled in the art from this detailed description.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

The present invention is directed to a collapsible container 10 which is used to dispense a liquid product therefrom. The collapsible container may be used in combination with a post-mix beverage system. Such a post-mix beverage system, which is hereby incorporated by reference, is disclosed in U.S. Pat. No. 4,014,461, issued Mar. 29, 1977 to Harvill and assigned to the same assignee as the present invention.

Figure 1:
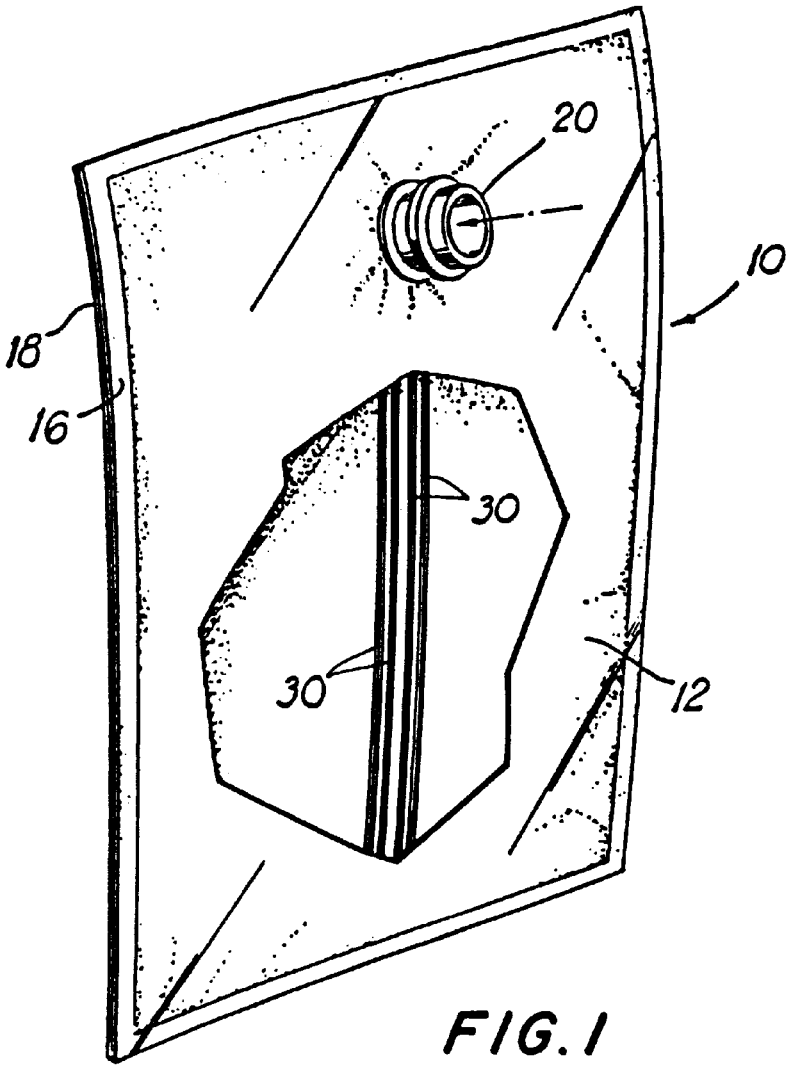
FIG. 1 is an isometric, partially cut away front side view of a collapsible bag according to the present invention.
Figure 2:
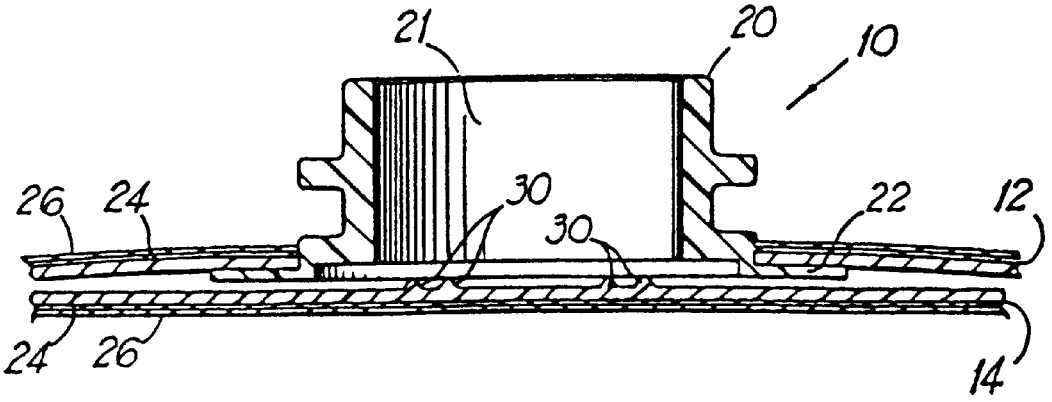
FIG. 2 is an enlarged cross sectional partial view of the collapsible bag including an annular spout adjacent to which are disposed a plurality of ribs according to the present invention.

As illustrated in FIGS. 1 and 2, the collapsible container 10 is made of a pair of sheets of flexible material 12 and 14 joined together at their respective peripheries 16 and 18. The flexible sheets are joined in a sealed relationship through out the periphery and in the case of flexible sheets made of thermoplastic material, this may be a seal achieved by means of heat sealing or suitable adhesive. The collapsible bag 10 includes an annular spout, or bag fitment 20 disposed through the flexible sheet 12 and attached thereto by means of an annular flange 22. The annular spout 20 may be of any desired geometry which can be adapted to fit into a coupling for a suction system. Indeed as would be obvious to a person of ordinary skill in the art, the annular spout 20 may be any shape including non-annular. As shown in more detail in FIG. 2, the flexible sheets 12 and 14 may comprise a number of plys, e.g. 24 and 26. In the preferred embodiment, two plys are used. Ply 24 is a web of 2 mil. EVA disposed adjacent to second ply 26 which is a bonded web made up of the following three sheets: 2 mil. EVA, ½ mil. metalized PET, and a 2 mil. EVA.

The collapsible container 10 of the present invention includes at least one pair of ribs 30 disposed through the length of the collapsible container 10, shown in FIG. 1, and in relation to the annular spout 20 so that the pair of ribs 30 passes substantially adjacent to, and in line with the opening 21 of the annular spout 20. Although a pair of ribs is described, a single rib or protrusion 30 of sufficient height would be sufficient to achieve the objectives of the invention, although not as efficiently as a pair of ribs. The ribs 30 are slight protrusions which are closely spaced together. The ribs 30 may be extruded onto the flexible sheet 14, or in the case of a two ply sheet, on the inner layer 24.

In the preferred embodiment, the ribs 30 are disposed on the flexible sheet opposite to the flexible sheet where the annular spout 20 is attached. However, the present invention will also encompass the placement of the ribs on the flexible sheet on which the annular spout 20 is disposed, which although not as efficient, also can provide significant advantages over the system shown in the prior art.

Figure 3:
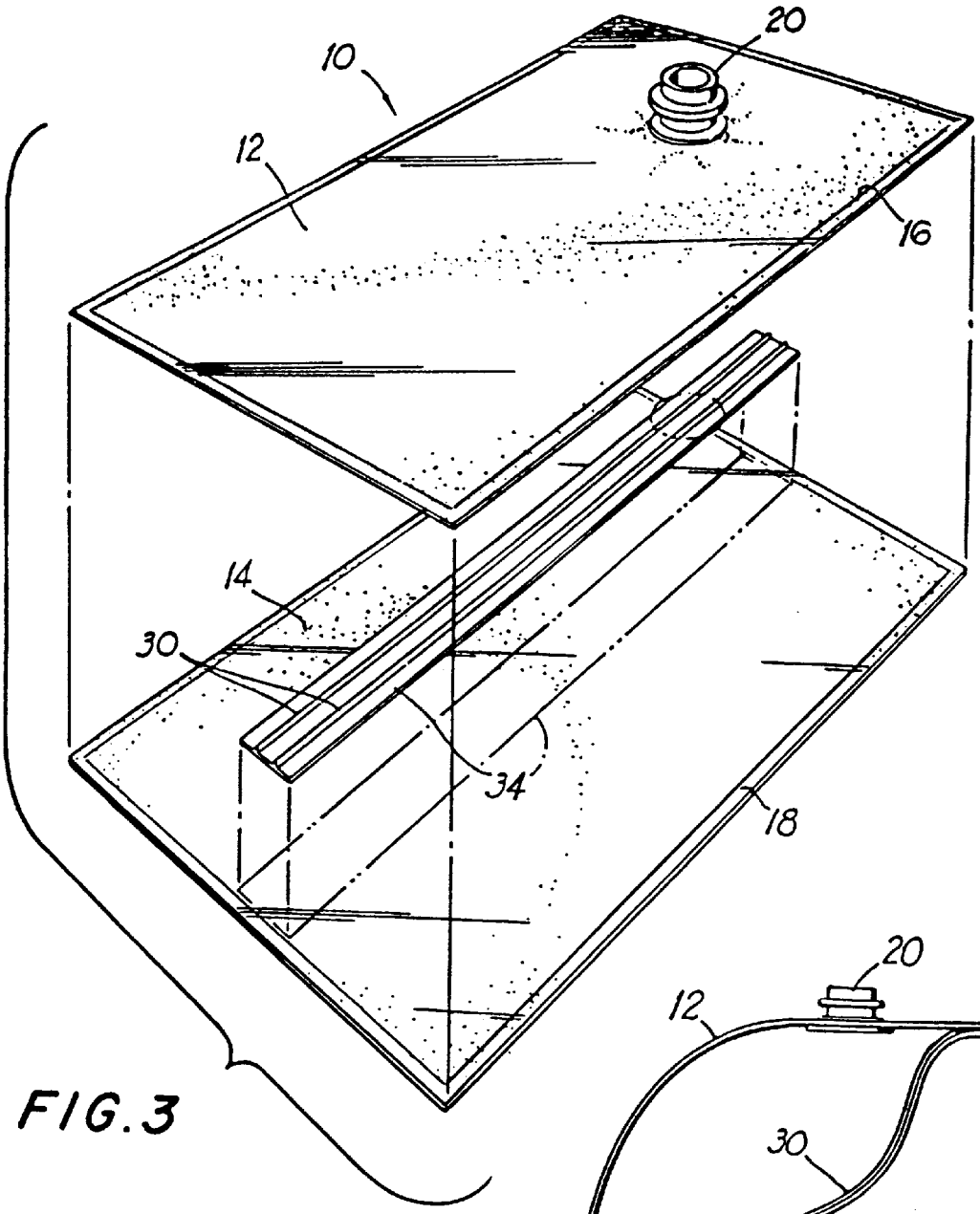
FIG. 3 is an exploded view of an embodiment of the present invention.
Figure 4:
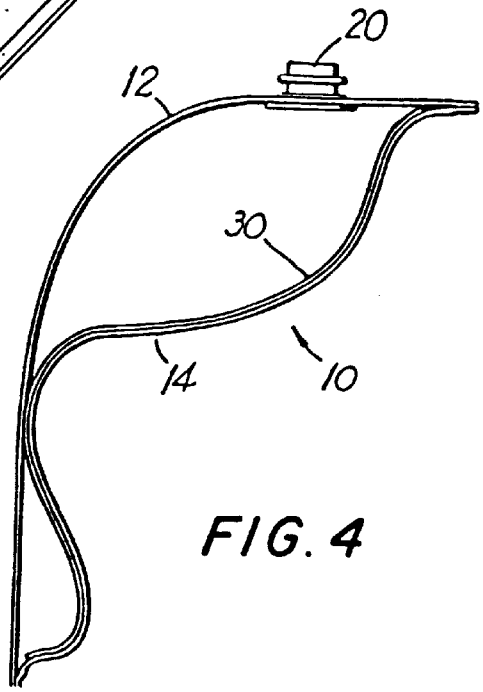
FIG. 4 is a lateral cross sectional view of a collapsible bag which illustrates the operation of the invention.

As illustrated in FIG. 3 another embodiment of the present invention includes a web strip 34 including at least one pair of ribs 30 disposed between the flexible sheets 12 and 14 and adjacent to, and in line with, the annular spout 20. The web strip 34 should be made of compatible material with the flexible sheets 12 and 14. For example, if the interior ply of the sheets 12 and 14 is made out of EVA then the web strip 34 should be made of EVA or compatible material (e.g. low density polyethylene). The web strip 34 is attached to the flexible sheets 12 and 14 during the formation of the bag, when the adjacent sheets are secured at their periphery, thus, for example, heat sealing of the adjacent flexible sheets 12 and 14 will also achieve the heat sealing and fixation of the flexible strip web 34. Illustrated in FIG. 4 is the operation of the ribs 30. As the flexible container 10 collapses, it has a tendency to collapse somewhat unevenly, leaving pockets of liquid which may become isolated from the rest of the liquid in the container. The ribs 30 form a conduit which cannot be closed off by the atmospheric pressure on the walls of the flexible sheets 12 and 14. Thus, the entire inner chamber of the flexible bag remains in communication with the spout 20 at all times during the operation.

The invention being thus described, it will be obvious that the same may be varied in many ways such variations are not to be regarded as a departure from the spirit and scope of the invention, and all such modifications as would be obvious to one of ordinary skill in the art are intended to be included within the scope of the following claims.

What is claimed is:

1. A method for producing a disposable flexible bag for use in containing and dispensing a liquid and including a spout having an opening through which the bag is to be filled and emptied, and said bag also including a liquid passage member inside of said bag having at least one elongated liquid channel in liquid flow communication with said spout opening as said bag progressively collapses against said liquid passage member, said method comprising:

a) providing a pair of flexible bag walls;

b) providing a spout in one of said bag walls having an opening therethrough and a longitudinal axis substantially perpendicular to said bag wall;

c) positioning said liquid passage member having said liquid channel inside of said bag walls prior to forming said bag walls into said bag;

d) positioning said liquid passage member inside of said bag walls such that when said bag walls are formed into said bag having no liquid contained therein, said liquid channel of said liquid passage member will be in liquid flow communication with said spout opening and disposed substantially perpendicular to said longitudinal axis of said spout; and e) forming said bag walls into said bag with said spout being connected through one of said bag walls.

2. The method as recited in claim 1 wherein said liquid passage member comprises a flat, elongated, flexible member having said liquid channel extending along its length.

3. The method as recited in claim 2 including positioning said flexible member between said pair of bag walls and directly underneath said spout, prior to forming said bag walls into said bag.

4. The method as recited in claim 3 further comprising securing said liquid passage member inside of said bag with said elongated channel in liquid flow communication with said opening in said spout.

5. The method as recited in claim 4 wherein said bag is formed by heat sealing and wherein said securing said liquid passage member comprises heat sealing said member in place.

6. The method as recited in claim 5 including heat sealing said member to at least one of said bag walls.

7. The method as recited in claim 5 wherein said bag is formed by heat sealing said bag walls along their respective peripheries, and wherein heat sealing said flexible member includes heat sealing at least one end of said flexible member between said bag walls at their peripheries simultaneously with said heat sealing of said bag walls along their peripheries.

8. The method as recited in claim 7 wherein said heat sealing said flexible member further includes heat sealing both ends of said flexible member between said bag walls at the periphery of said bag.

9. The method as recited in claim 1 wherein said liquid passage member is a flat, flexible member.

10. The method as recited in claim 9 wherein said member is narrow and elongated.

11. The method as recited in claim 11 wherein said liquid passage member comprises at least one rib that defines said liquid channel and that prevents said bag walls from blocking liquid flow through said liquid channel when said bag walls have collapsed against said liquid passage member.

12. A method for producing a disposable, flexible bag for use in containing and dispensing a liquid, comprising:

a) providing a pair of rectangular bag walls;

b) heat sealing a spout having a longitudinal axis and a spout opening therethrough to one of said bag walls with the longitudinal axis thereof substantially perpendicular to said bag wall;

c) positioning a flexible, flat, elongated liquid passage member between said pair of bag walls and adjacent to said spout prior to sealing said bag walls together to form said bag, said liquid passage member having at least one liquid channel therealong in liquid flow communication with said spout opening as said bag empties and progressively collapses against said liquid passage member;

d) heat sealing said bag walls together to form said bag with said liquid passage member positioned in-between said walls; and e) securing said liquid passage member in said bag with said channel substantially perpendicular to said longitudinal axis of said spout when said bag is in an unfilled condition.

13. The method as recited in claim 12 wherein said securing said liquid passage member comprises heat sealing said liquid passage member in place simultaneously with heat sealing at least a portion of said walls together to form said bag.

14. The method as recited in claim 12 wherein said heat sealing said liquid passage member comprises heat sealing said liquid passage member to at least one of said walls.

15. The method as recited in claim 12 wherein said positioning said liquid passage member further comprises disposing said liquid passage member across said spout opening when said bag is in said unfilled condition.

16. The method as recited in claim 12 wherein said liquid passage member further comprises at least one rib, whereby said rib prevents said bag walls from blocking said liquid channel when said bag wall collapses against said liquid passage member.

17. The method as recited in claim 12 wherein said heat sealing said bag walls comprises heat sealing said bag walls along their respective peripheries.

18. The method as recited in claim 17 wherein said heat sealing said flexible member in place inside of said bag further comprises heat sealing at least one end of said flexible member between said bag walls at their peripheries simultaneously with said heat sealing of said bag walls along their peripheries.

19. The method as recited in claims 18 wherein said heat sealing said flexible member further includes heat sealing both ends of said flexible member between said bag walls at the periphery of said bag.

20. A disposable, flexible bag for use in containing and dispensing a liquid comprising:

a) a pair of rectangular bag walls heat sealed together at their peripheries to form a flat rectangular unfilled bag;

b) a spout having a longitudinal axis and a spout opening therethrough and heat sealed to one of said bag walls with said longitudinal axis substantially perpendicular to said bag wall;

c) a flexible, flat, elongated liquid passage member positioned inside of said flat bag and having at least one liquid channel formed along at least a portion thereof; and d) said liquid passage member being secured in said bag and being located in liquid flow communication with said spout opening and with said liquid passage member being disposed substantially perpendicular to said longitudinal axis of said spout when said bag is in an unfilled condition.

21. The article of claim 20, wherein said elongated liquid passage member includes at least one pair of spaced-apart ribs defining said liquid channel.

22. The article of claim 21, wherein said ribs are parallel to each other and extend in a straight line between the ends of said member and across said spout opening when said bag is in an empty, pre-filled condition.

23. The article of claim 21, wherein said ribs are integral with the bag wall opposite said spout opening.

24. The article of claim 20, wherein at least one end of said liquid passage member is heat sealed in the bag.

25. The article of claim 24, wherein said at least one end of said liquid passage member is heat sealed to a periphery of said bag.

26. The article of claim 25 wherein both ends of said liquid passage member are heat sealed between said pair of bag walls at the periphery of said bag.

* * * * *